US010501994B2

(12) United States Patent
Wang

(10) Patent No.: US 10,501,994 B2
(45) Date of Patent: Dec. 10, 2019

(54) APPARATUS AND METHOD FOR DIRECTIONAL DRILLING OF BOREHOLES

(71) Applicant: Duane Xiang Wang, Edmonton (CA)

(72) Inventor: Duane Xiang Wang, Edmonton (CA)

(73) Assignee: Duane Xiang Wang, Edmonton (CA)

( * ) Notice: Subject to any disclaimer, the term of this patent is extended or adjusted under 35 U.S.C. 154(b) by 71 days.

(21) Appl. No.: 15/698,296

(22) Filed: Sep. 7, 2017

(65) Prior Publication Data

US 2018/0080283 A1 Mar. 22, 2018

Related U.S. Application Data

(60) Provisional application No. 62/395,746, filed on Sep. 16, 2016.

(51) Int. Cl.

| | |
|---|---|
| ***E21B 7/06*** | (2006.01) |
| ***E21B 47/024*** | (2006.01) |
| *E21B 4/02* | (2006.01) |
| *E21B 44/00* | (2006.01) |

(52) U.S. Cl.

CPC ..... *E21B 7/064* (2013.01); *E21B 47/024* (2013.01); *E21B 4/02* (2013.01); *E21B 7/061* (2013.01); *E21B 44/005* (2013.01)

(58) Field of Classification Search

CPC ..... E21B 7/064; E21B 7/067; E21B 17/1014

See application file for complete search history.

(56) References Cited

U.S. PATENT DOCUMENTS

| | | | | |
|---|---|---|---|---|
| 6,059,661 | A | 5/2000 | Simpson | |
| 6,340,063 | B1 * | 1/2002 | Comeau | E21B 7/062 175/61 |
| 2001/0052428 | A1 | 12/2001 | Larronde et al. | |
| 2011/0120775 | A1 * | 5/2011 | Krueger | E21B 7/067 175/73 |
| 2013/0319764 | A1 * | 12/2013 | Schaaf | E21B 7/06 175/24 |
| 2016/0138381 | A1 | 5/2016 | Logan et al. | |

* cited by examiner

*Primary Examiner* — Giovanna C Wright

(74) *Attorney, Agent, or Firm* — Adler Pollock & Sheehan P.C.

(57) ABSTRACT

Directional drilling of a borehole involves: positioning an apparatus in a borehole such that a housing of the apparatus and the borehole wall define an outer annular space; flowing drilling fluid to the outer annular space via an inner annular space defined between the housing and an inner drive shaft of the apparatus; actuating a clutch for selectively coupling the housing to the drive shaft for rotation with the drive shaft and for adjusting the tool face of the housing; and actuating a valve to control drilling fluid flow between the outer annular space to a piston chamber, relative to drilling fluid flow between the inner annular space and the piston chamber to thereby control drilling fluid pressure in the piston chamber. The drilling fluid pressure in the piston chamber and a biasing means act in opposing directions on a piston to urge the piston either towards or away from the borehole wall. When urged towards the borehole wall, the piston presses against the borehole wall to limit rotation of the housing within the borehole.

26 Claims, 3 Drawing Sheets

APPARATUS AND METHOD FOR DIRECTIONAL DRILLING OF BOREHOLES

CROSS REFERENCE TO RELATED APPLICATION

This application is a U.S. Non-Provisional patent application which claims priority from U.S. Provisional application for Patent No. 62/395,746 filed Sep. 16, 2016 which is incorporated herein by reference.

TECHNICAL FIELD

The present invention relates to apparatuses and methods for directional drilling of boreholes in geological formations.

BACKGROUND OF THE INVENTION

The prior art includes a variety of apparatuses and methods for directional drilling of vertical or non-vertical boreholes in geological formations for recovery of oil and gas.

Directional drilling may be performed with steerable motor systems, in which a drill string includes a bent tubular section and an internal mud motor that rotates a drill bit. Operation of the system is alternated between a rotary mode and a sliding mode to change the trajectory of the borehole. During the rotary mode, a torque device such as a rotary table or a top drive rotates the entire drill sting (including the drill bit) to advance the borehole in a substantially straight path. During the sliding mode, the mud motor rotates only the drill bit to slide the drill string along a curved trajectory dictated by the bent tubular section of the drill string.

Directional drilling may be performed with "push the bit" rotary steerable systems (RSS), in which a drill string includes a straight rotatable tubular section with a plurality of actuable pads near the drill bit. As the tubular section rotates, the pads radially extend and retract from the tubular section so that they apply a controlled resultant radial force to the borehole wall, and thereby force the axis of drill string in a desired direction. However, such systems require a relatively complex valve mechanism to synchronously control the extension of the pads to achieve the desired effect.

Directional drilling may be performed with "point the bit" rotary steerable systems, in which a drill string includes a straight rotatable outer tubular section with an inner drill bit shaft that is adjustable in orientation with respect to the outer tubular section. However, such systems require a mechanism, such as a servomotor, to adjust the orientation of the inner drill bit shaft with respect to the outer tubular housing.

Directional drilling may be performed with systems in which pads or equivalent parts are actuated to engage the borehole wall to limit rotation of a bent tubular section while rotation of an internal drill string advances the drill bit. For example, U.S. Pat. No. 6,059,661 to Simpson discloses a directional drilling system in which pressurized hydraulic fluid actuates pistons that force grip pads radially outward from a stabilizer to anchor the stabilizer in the wellbore. In one embodiment, a hydraulic pump internal to the system pressurizes the hydraulic fluid from an internal reservoir to an internal gallery to extend the grip pads. A remotely controllable valve may control the flow of hydraulic fluid between the reservoir and gallery. United States Patent Application Publication No. 2001/0052428 to Larronde et al. discloses a downhole steering tool in which guide members move to engage the borehole to hold a steering housing against rotation while a drill string rotates a drill bit. The guide members are actuated by hydraulic passage leading to a hydraulic pump incorporated within the steering housing and driven by an electrical motor supplied with power from a MWD pump. United States Patent Application Publication No. 2016/0138381 to Logan et al. discloses an apparatus for directional drilling that allows an uphole section of a drill string to be rotated while maintaining a desired orientation of a bent section of the drill string with the use of pads that can be urged outwardly to engage walls of the wellbore, but does not disclose how the pads are actuated beyond indicating that they are hydraulically actuated.

There remains a need for improved apparatuses and methods for directional drilling that are reliable and avoid such complexities of the prior art.

SUMMARY OF THE INVENTION

In one aspect, the present invention comprises an apparatus for directional drilling of a borehole defined by a borehole wall. The apparatus is locatable between an uphole drill string defining a drill string bore for flow of a drilling fluid and a downhole drill bit defining a drill bit opening for flow of the drilling fluid.

The apparatus comprises a bent tubular housing for imparting a direction to the borehole. When the apparatus is disposed in the borehole, an outer annular space defined between an outer wall of the housing and the borehole wall is in drilling fluid communication with the drill bit opening.

The apparatus further comprises a drive shaft for coupling rotation of the drill string to the drill bit. The drive shaft is disposed within the housing. When the drill string and the drill bit are coupled to the drive shaft, an inner annular space defined between an inner wall of the housing and the drive shaft is in drilling fluid communication with the drill string bore and the drill bit opening.

The apparatus further comprises at least one piston in drilling fluid communication with a piston chamber attached to the housing and in drilling fluid communication with the outer annular space and the inner annular space. The piston is movable relative to the housing to, in use, apply pressure to the borehole wall and thereby limit rotation of the housing within the borehole.

The apparatus further comprises a biasing means. The piston, the piston chamber and the biasing means are arranged such that a drilling fluid pressure in the piston chamber urges the piston in a first direction towards the borehole wall, and the biasing means urges the piston in a second direction away from the borehole wall, or vice versa.

The apparatus further comprises at least one valve for selectively controlling drilling fluid flow between the outer annular space and the piston chamber, relative to drilling fluid flow between the inner annular space and the piston chamber and thereby, in use, controlling the drilling fluid pressure variation in the piston chamber.

The apparatus further comprises a clutch for selectively coupling the housing to the drive shaft for rotation with the drive shaft and for adjusting the tool face of the housing.

In an exemplary embodiment, the valve is actuable between a first state and a second state. In the first state, the valve prevents drilling fluid communication from the inner annular space to the piston chamber, and permits drilling fluid communication from the piston chamber to the outer annular space. In the second state, the valve permits drilling fluid communication from the inner annular space to the piston chamber, and prevents drilling fluid communication from the piston chamber to the outer annular space.

In embodiments of the apparatus, the piston chamber is in drilling fluid communication with the inner annular space via an inlet passage defined by the housing.

In embodiments of the apparatus, the piston chamber is in drilling fluid communication with the outer annular space via an outlet passage defined by the housing.

In embodiments of the apparatus, the drive shaft comprises a tubular uphole portion for drilling fluid communication between the drill string bore and the inner annular space, as well as a tubular downhole portion for drilling fluid communication between the inner annular space and the drill bit opening.

In embodiments of the apparatus, the drive shaft comprises a tubular intermediate portion, and a universal joint coupling the tubular intermediate portion to the tubular downhole portion for permitting rotation of the drive shaft within the housing while accommodating a bend angle of the housing.

In embodiments of the apparatus, the clutch comprises a clutch member attached to the inner wall of the housing, the clutch member being actuable to extend radially inwards to be operably connected or into engagement with the drive shaft.

In embodiments of the apparatus, the valve is selected from a two-way valve, a solenoid valve, or an annular valve member.

In embodiments of the apparatus, the valve, the clutch, or both are remotely controllable from outside of the borehole.

In embodiments of the apparatus, the apparatus comprises one valve or more than one valve.

In embodiments of the apparatus, the apparatus comprises more than one piston.

In embodiments of the apparatus, the apparatus comprises an electronic control module comprising a first processor attached to the housing and a second processor at surface and remotely communicating with the first processor for operating the apparatus.

In another aspect, the present invention comprises a method for directional drilling of a borehole defined by a borehole wall. The method comprises the steps of:

(a) positioning an apparatus within the borehole, the apparatus located between an uphole drill string defining a drill string bore and a downhole drill bit defining a drill bit opening, the apparatus comprising:
  (i) a bent tubular housing for imparting a direction to the borehole, wherein an outer annular space defined between an outer wall of the housing and the borehole wall is in drilling fluid communication with the drill bit opening;
  (ii) a drive shaft for coupling rotation of the drill string to the drill bit, wherein the drive shaft is disposed within the housing, wherein an inner annular space defined between an inner wall of the housing and the drive shaft is in drilling fluid communication with the string bore and the drill bit opening;
  (iii) at least one piston in drilling fluid communication with a piston chamber attached to the housing and in drilling fluid communication with the outer annular space and the inner annular space, wherein the piston is movable relative to the housing to, in use, apply pressure to borehole wall and thereby limit rotation of the housing within the borehole;
  (iv) a biasing means, wherein the piston, the piston chamber and the biasing means are arranged such that drilling fluid pressure in the piston chamber urges the piston in a first direction towards the borehole wall, and the biasing means urges the piston in a second direction away from the borehole wall, or vice versa;
  (v) at least one valve for selectively controlling drilling fluid flow between the outer annular space and the piston chamber, relative to drilling fluid flow between the inner annular space and the piston chamber and thereby, in use, controlling the drilling fluid pressure in the piston chamber; and
  (vi) a clutch for selectively coupling the housing to the drive shaft for rotation with the drive shaft and for adjusting the tool face of the housing;
(b) flowing the drilling fluid from the drill string bore to the outer annular space via the inner annular space and the drill bit opening to establish a drilling fluid pressure differential between the inner annular space and the outer annular space;
(c) actuating the clutch for selectively coupling the housing to the drive shaft for rotation with the drive shaft and for adjusting the tool face of the housing; and
(d) actuating the at least one valve to selectively control drilling fluid flow between the outer annular space and the piston chamber, relative to drilling fluid flow between the inner annular space and the piston chamber, and thereby control drilling fluid pressure in the piston chamber to urge the piston to press against the borehole wall and thereby limit rotation of the housing within the borehole.

In embodiments, the valve is actuable between a first state and a second state. In the first state, the valve prevents drilling fluid communication from the inner annular space to the piston chamber, and permits drilling fluid communication from the piston chamber to the outer annular space. In the second state, the valve permits drilling fluid communication from the inner annular space to the piston chamber, and prevents drilling fluid communication from the piston chamber to the outer annular space.

In embodiments of the method, the drilling fluid flows between the inner annular space and the piston chamber via an inlet passage defined by the housing.

In embodiments of the method, drilling fluid flows between the outer annular space and the piston chamber via an outlet passage defined by the housing.

In embodiments of the method, the drilling fluid flows from the drill string bore to the inner annular space via a tubular uphole portion of the drive shaft, and flows from the inner annular space to the drill bit opening via a tubular downhole portion of the drive shaft.

In embodiments of the method, the clutch comprises a clutch member attached to the inner wall of the housing, the clutch member being actuable to extend radially inwards to be operably connected or into engagement with the drive shaft.

In embodiments of the method, the valve is selected from a two-way valve, a solenoid valve, or an annular valve member.

In embodiments of the method, actuating the valve, the clutch, or both comprises remotely controlling the valve, the clutch, or both from outside of the borehole.

In embodiments of the method, the apparatus comprises one valve or more than one valve.

In embodiments of the method, the apparatus comprises more than one piston.

In embodiments of the method, the apparatus is electronically controlled by an electronic control module comprising a first processor attached to the housing and a second processor at surface and remotely communicating with the first processor.

BRIEF DESCRIPTION OF THE DRAWINGS

Exemplary embodiments of the present invention are described with reference to the following drawings. In the drawings, like elements are assigned like reference numerals. The drawings are not necessarily to scale, with the emphasis instead placed upon the principles of the present invention. Additionally, each of the embodiments depicted is but one of a number of possible arrangements utilizing the fundamental concepts of the present invention. The drawings are briefly described as follows.

DETAILED DESCRIPTION OF THE INVENTION

The present invention relates to directional drilling of boreholes. Any term or expression not expressly defined herein shall have its commonly accepted definition understood by a person skilled in the art. As used herein, the terms "uphole" and "downhole" describe relative positions between two parts along the borehole. A first part that is "uphole" of a second part is more proximal to the surface than the second part along the path defined by the borehole. Conversely, a first part that is "downhole" of a second part is more distal from the surface than the second part along the path defined by the borehole.

Figure 1:
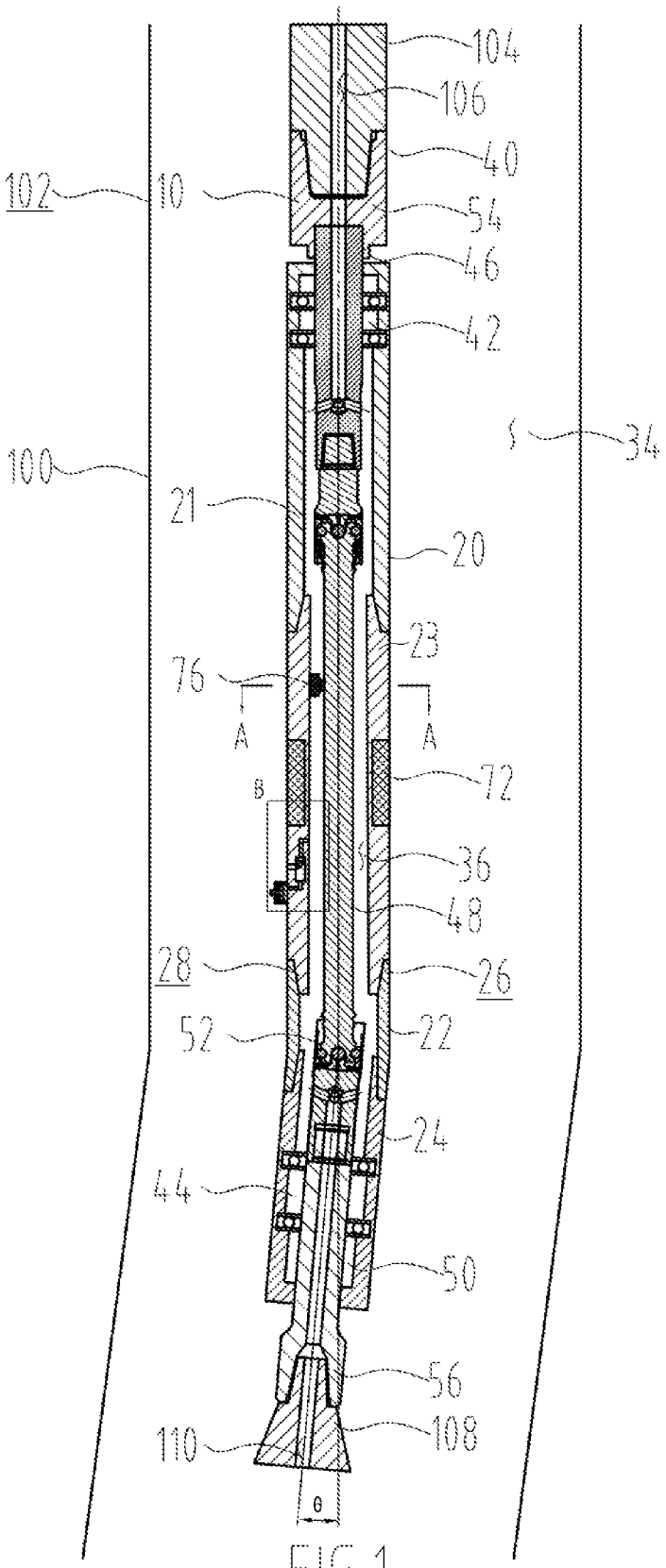
FIG. 1 is a longitudinal sectional view of an embodiment of the apparatus of the present invention, connected to an uphole drill string and a downhole drill bit within a borehole.

FIG. 1 shows a longitudinal sectional view of an embodiment of the apparatus (10) of the present invention as part of a directional drilling system within a borehole (100) defined by a borehole wall (102). The uphole and downhole ends of the borehole (100) are located towards the top and bottom, respectively, of FIG. 1. The apparatus (10) is located between an uphole drill string (104) and a downhole drill bit (108). In an exemplary use, a drilling rig (not shown) at the surface is associated with a torque device (not shown) such as a top drive, rotary table or Kelly drive that rotates the drill string (104). Further, a pump (not shown) at the surface pressurizes drilling fluid (also referred to as drilling mud) downwardly through the drill string bore (106) and ultimately through a drill bit opening (110) (e.g., a drill bit nozzle). As known by persons skilled in the art, the components of the drilling system may be operatively connected to a control module comprising one or more processors (i.e., computing devices such as microprocessors) that are located downhole and/or at the surface for controlling the operation of the drilling system.

The apparatus (10) generally comprises a stationary "outer string" and a rotatable "inner string" which is positioned to rotate within the outer string. The stationary outer string and rotatable inner string are connected by uphole and downhole bearing assemblies (42, 44). As will be further described in detail, the stationary outer string generally comprises a bent tubular housing (20) which includes an upper stationary housing (21), an electronic housing (23) comprising a processor (72), bent housing uphole portion (22), and housing downhole portion (24). The rotatable inner string generally comprises a drive shaft (40) which includes a drive shaft uphole portion (46), drive shaft intermediate portion (48), universal joint (52), and drive shaft downhole portion (50).

In the exemplary embodiment of FIG. 1, the apparatus (10) includes a bent tubular housing (20), a drive shaft (40), at least one piston (60) in a piston chamber (62), a valve (70), a biasing means (74) and a clutch (76), as further described below. The parts of the apparatus (10) may be made of any material known in the art that is suitably hard and durable for the downhole environment including, without limitation, steel alloy materials.

The bent tubular housing (20) imparts a direction to the borehole (100). The housing (20) is bent in the sense that it comprises a bent housing uphole portion (22) and a housing downhole portion (24) having respective longitudinal centerlines that form a non-zero angle, θ. In an exemplary embodiment, for example, the angle θ may be between 0 and 4 degrees. When the apparatus (10) is disposed within the borehole (100) as shown in FIG. 1, an outer annular space (34) is defined between the borehole wall (102) and an outer wall (26) of the housing (20).

The drive shaft (40) couples rotation of the drill string (104) to the drill bit (108). The drive shaft (40) is positioned within the housing (20) such that an inner annular space (36) is defined between the drive shaft (40) and an inner wall (28) of the housing (20). In the exemplary embodiment of FIG. 1, the drive shaft (40) extends through the housing (20) and is rotationally disposed with the housing (20) by means of an uphole bearing assembly (42) and a downhole bearing assembly (44). In the exemplary embodiment of FIG. 1, the drive shaft (40) comprises a drive shaft uphole portion (46), a drive shaft intermediate portion (48), and a drive shaft downhole portion (50). A universal joint (52) couples the drive shaft intermediate portion (48) to the drive shaft downhole portion (50) so as to permit rotation of the drive shaft (40) within the housing (20) while accommodating the bend angle of the housing (20). The drive shaft uphole portion (46) comprises a threaded box connection (54) for coupling the drive shaft (40) to a complementary threaded pin connection of the drill string (104). Further, the drive shaft uphole portion (46) is tubular for drilling fluid communication from the drill string bore (106) to the inner annular space (36). The drive shaft downhole portion (50) comprises a threaded box connection (56) for coupling the drive shaft (40) to a complementary threaded pin connection of the drill bit (108). Further, the drive shaft downhole portion (50) is tubular for drilling fluid communication from the inner annular space (36) to the drill bit opening (110). In the exemplary embodiment, the apparatus (10) includes sealing elements so that the outer annular space (34) and the inner annular space (36) are not in drilling fluid communication except via the drill bit opening (110).

The piston chamber (62) is attached to the housing (20) and defines a space in drilling fluid communication with the outer annular space (34) and the inner annular space (36). At least one piston (60) moves within the piston chamber (62) so as to press against the borehole wall (102) and thereby limit rotation of the housing (20) within the borehole (100) by virtue of friction between the interfacing surfaces of the piston (60) and the borehole wall (102). As used herein, "limit rotation" includes limiting a non-zero amount of rotation as well as entirely preventing rotation.

Figure 3:
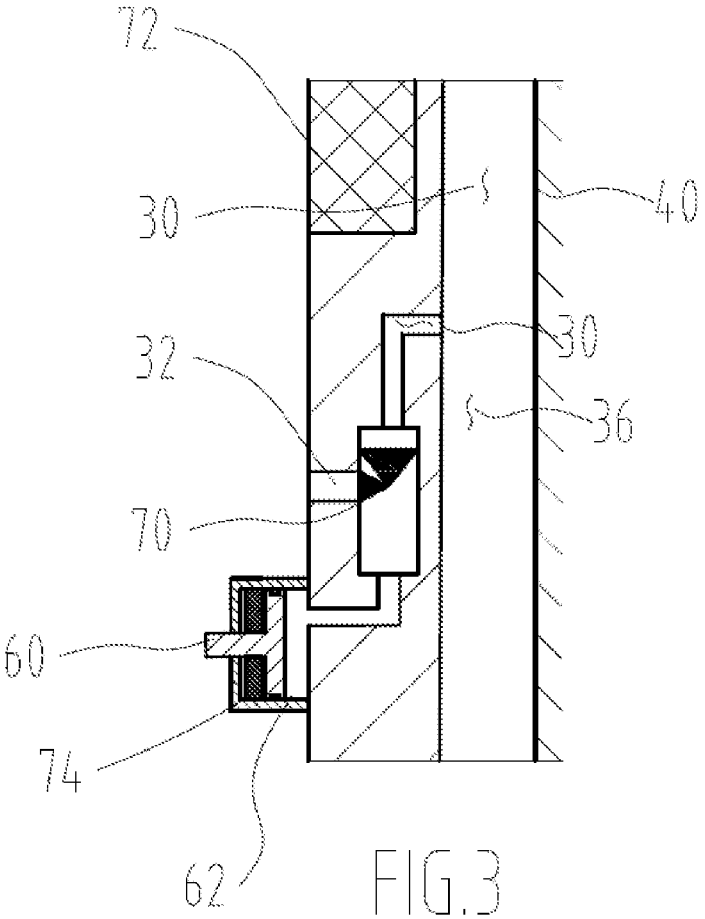
FIG. 3 is a detailed view of the apparatus of FIG. 1 at region B of FIG. 1.

In the exemplary embodiment shown in FIG. 3, the piston chamber (62) is formed externally on the outer wall (26) of the housing (20), and has an annular or partial annular shape circumferential about the housing (20). The apparatus (10) has three pistons (60) that are arranged circumferentially around the housing (20), with equal-angular separation of 120 degrees. In other embodiments, the apparatus (10) may have a fewer or greater number of pistons (60) in different geometric arrangements. The pistons (60) are moveable radially outward relative to the housing (20) to press against the borehole wall (102), and movable radially inward relative to the housing (20) to disengage from the borehole wall (102). The portion of each piston (60) disposed within the piston chamber (62) has sealing elements that seal against the walls of the piston chamber (62). The piston chamber (62) is in drilling fluid communication with the inner annular space (36) via an inlet passage (30) defined by the housing (20) between the inner wall (28) and the outer wall (26) of the housing (20). The piston chamber (62) is also in drilling fluid communication with the outer annular space (34) via an outlet passage (32) defined by the housing (20) between the inner wall (28) and the outer wall (26) of the housing (20).

The biasing means (74) may comprise any device known in the art that is suitable for urging the piston (60) to move relative to the housing (20). For example, in the exemplary embodiment shown in FIG. 3, the biasing means (74) may comprise a mechanical spring such as a coil or helical spring, a flat spring, or a member made of a resilient material (e.g., an elastomer) that is compressed between the wall of the piston chamber (62) and the portion of the piston (60) within the piston chamber (62).

The piston (60), the piston chamber (62) and the biasing means (74) are arranged such that drilling fluid pressure in the piston chamber (62) urges the piston (60) in a first direction, and the biasing means (74) urges the piston (60) in a second direction. In the exemplary embodiment shown in FIG. 3, the first direction is towards the borehole wall (102), while the second direction is away from the borehole wall (102). In other embodiments, the arrangement may be reversed such that the first direction is away from the borehole wall (102), while the second direction is away from towards the borehole wall (102).

At least one valve (70) selectively controls drilling fluid communication between the outer annular space (34) and the piston chamber (62), and between the inner annular space (36) and the piston chamber (62). In the exemplary embodiment of FIG. 3, the valve (70) is shown schematically as a single valve with a valve symbol for a two-way valve. In other embodiments, there may be more than one valve (70). It will be understood that that valve (70) may comprise any device or devices known in the art that is suitable for controlling drilling flow between the outer annular space (34) and the piston chamber (62) relative to drilling fluid flow between the inner annular space (36) and the piston chamber (62). By way of a non-limiting example, the valve (70) may comprise an annular valve member (not shown) that is disposed within and in sealing engagement with the inner wall (28) of the housing (20), and which moves axially relative to the housing (20) to occlude or expose the inlet passage (30) to the inner annular space (36). In exemplary embodiments, the valve (70) may be remotely controllable from outside of the borehole (100). By way of non-limiting example, the valve (70) may be a solenoid valve that is electromechanically operated by means of an electronic control module comprising a first processor (72) attached to the housing (20) and a second processor (not shown) at the surface and remotely communicating with the first processor (72).

The clutch (76) is used to perform dual functions, namely the rotary drilling and adjusting the tool face of the housing (20). The clutch (76) selectively couples the housing (20) to the drive shaft (40) for rotation with drive shaft (40). The clutch (76) may comprise any device known in the art that is suitable for transmitting torque from the drive shaft (40) to the housing (20). For example, in the exemplary embodiment shown in FIGS. 1 and 2, the clutch (76) comprises a clutch member (78) attached to the inner wall (28) of the housing (20), with a gap between the clutch member (78) and the drive shaft (40). The clutch member (78) can be actuated to extend radially inwards to be operably connected or into engagement in a suitable manner with the drive shaft (40), omitting the gap. In one embodiment, the clutch member (78) extends radially inwards into frictional engagement with the drive shaft (40).

The clutch (76) may be remotely controllable from outside of the borehole (100) by means of an electronic control module comprising a first processor (72) attached to the housing (20) and a second processor (not shown) at the surface and remotely communicating with the first processor (72).

Figure 2:
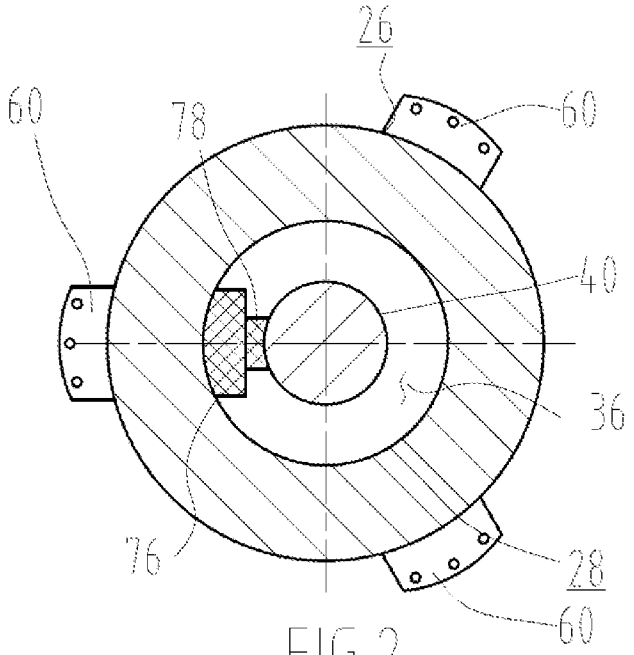
FIG. 2 is a sectional view of the apparatus of FIG. 1 at section A-A of FIG. 1.

An exemplary use and operation of the exemplary embodiment of the apparatus (10) shown in FIGS. 1 to 3 is now described. The apparatus (10) is positioned within the borehole (100), with the drive shaft (40) coupled to the drill string (104) and the drill bit (108). A pump (not shown) at the surface pressurizes drilling fluid so that it flows in the downhole direction through the drill string bore (106) and into the inner annular space (36) via the tubular drive shaft uphole portion (46). The drilling fluid continues in the downhole direction through the tubular drive shaft downhole portion (50) and the drill bit opening (110) into the outer annular space (34).

A drilling fluid pressure differential between the inner annular space (36) and the outer annular space (34) is established. For example, the drilling fluid flow rate, the size of the drill bit opening (110) or other flow restriction devices may be selected so that the drilling fluid pressure within the inner annular space (36) is higher than the drilling fluid pressure in the outer annular space (34). The drilling fluid in the outer annular space (34) flows in the uphole direction towards the surface carrying along with it cuttings that are produced by the abrasion of the drill bit (108) with the advancing borehole wall (102). During drilling operations, the first processor (72) and the second processor (not shown) at the surface and remotely communicating with the first processor may be used to monitor the tool face orientation of the drill bit.

When it is desired to advance the borehole (100) in a straight trajectory, the apparatus (10) is configured into a rotary mode. The configuration process may be automated in part or in full with the assistance of processors. The apparatus (10) operates under electronic control, whereby an electronic control module comprises the first processor (72) attached to the housing (20) and the second processor (not shown) at the surface and remotely communicating with the first processor.

Figure 4:
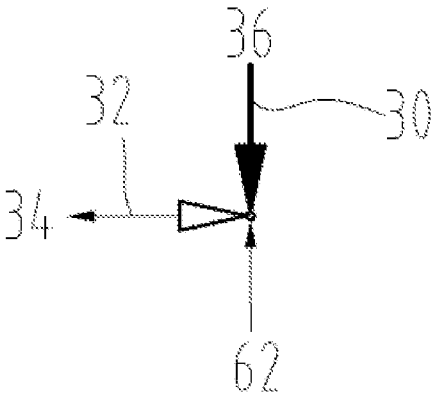
FIG. 4 is a schematic representation of a valve of the apparatus in a first state where the valve prevents drilling fluid communication from the inner annular space to the piston chamber via the inlet passage, and permits drilling fluid communication from the piston chamber to the outer annular space via the outlet passage in an exemplary use of an exemplary embodiment of the apparatus in a rotary mode.
Figure 5:
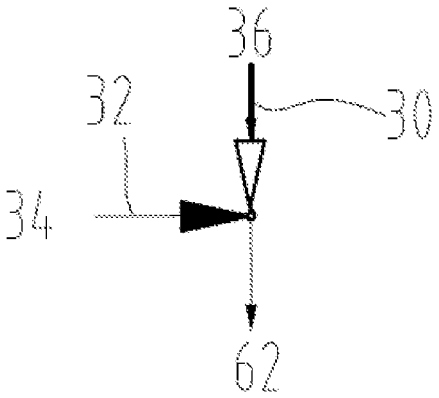
FIG. 5 is a schematic representation of a valve of the apparatus in a second state where the valve permits drilling fluid communication from the inner annular space to the piston chamber via the inlet passage, and prevents drilling fluid communication from the piston chamber to the outer annular space via the outlet passage in an exemplary use of an exemplary embodiment of the apparatus in a sliding mode.

In the rotary mode, the clutch (76) couples the housing (20) to the drive shaft (40) for rotation with the drive shaft (40). Further, as shown schematically in FIG. 4, the valve (70) is actuated to a first state where the valve (70) prevents drilling fluid communication from the inner annular space (36) to the piston chamber (62) via the inlet passage (30) (as indicated by the non-arrow line and the shaded valve member), and permits drilling fluid communication from the piston chamber (62) to the outer annular space (34) via the outlet passage (32) (as indicated by the arrow lines and the unshaded valve member). Accordingly, the drilling fluid pressure in the piston chamber (62) will tend towards equilibrium with the drilling fluid pressure in the outer annular space (34). The stiffness of the biasing means (74) is pre-selected such that the radially outward resultant force applied to the piston (60) by the expected drilling fluid pressure in the piston chamber (62) during the rotary mode is less than the radially inward biasing force applied by the biasing means (74) to the piston (60). Accordingly, the piston (60) moves radially inward away from the borehole wall (102) and disengages from the borehole wall (102) entirely, or at least applies a pressure to the borehole wall (102) that is insufficient to limit rotation of the housing (20) within the borehole (100). As the piston (60) moves radially inward within the piston chamber (62), the piston (60) displaces the drilling fluid in the piston chamber (62) to the outer annular space (34) via the outlet passage (32). While in the rotary mode, the torque device (not shown) such as a top drive, rotary table or Kelly drive rotates the drill string (104), and the rotationally coupled drive shaft (40), drill bit (108) and housing (20). It will be appreciated that the rotation of the bent tubular housing (20) will cause the borehole (100) to have a slightly enlarged diameter, but advance in a straight trajectory.

When it is desired to advance the borehole (100) in a deviated trajectory from the existing borehole (100) path, the apparatus (10) is configured into a sliding mode. The configuration process may be automated in part or in full with the assistance of the processor (72). In the sliding mode, the clutch (76) decouples the housing (20) from rotation with the drive shaft (40). Nonetheless, it will be appreciated that rotation of the drive shaft (40) within the housing (20) may induce some rotational tendency in the housing (20) due to phenomena such as seal friction. Therefore, the valve (70) is actuated to a second state where the valve (70) permits drilling fluid communication from the inner annular space (36) to the piston chamber (62) via the inlet passage (30) (as indicated by the unshaded valve member and the arrow lines), and prevents drilling fluid communication from the piston chamber (62) to the outer annular space (34) via the outlet passage (as indicated by the shaded valve member and non-arrow line). Accordingly, the drilling fluid pressure in the piston chamber (62) will tend towards equilibrium with the drilling fluid pressure in the inner annular space (36). The stiffness of the biasing means (74) is pre-selected such that the radially outward resultant force applied to the piston (60) by the expected drilling fluid pressure in the piston chamber (62) during the sliding mode is greater than the radially inward biasing force applied by the biasing means (74) to the piston (60). It will be appreciated that the drilling fluid will tend to flow into the piston chamber (62) without the need for pressurization beyond that provided by the drilling fluid pump (not shown) at the surface if the resultant force of the drilling fluid pressure in the inner annular space (36) is sufficiently high. Accordingly, the piston (60) moves radially outwards towards the borehole wall (102) and applies a pressure to the borehole wall (102) that is sufficient to limit rotation of the housing (20) within the borehole (100) by frictional engagement. While in the sliding mode, the torque device (not shown) such as a top drive, rotary table or Kelly drive rotates the drill string (104), while the pistons (60) limit rotation of the housing (20) within the wellbore. As the drill string (104) rotates the drill bit (108), the borehole (100) will advance along a curved trajectory imparted by the non-rotating housing (20) as it slides along the advancing borehole (100).

It will be appreciated that the apparatus of the present invention may be operated without the need for any pumping devices additional to the drilling fluid pump at the surface to push the pads out. Further, it will be appreciated that a single valve may be used to control the actuation of a plurality of pistons.

The present invention has been described above and shown in the drawings by way of exemplary embodiments and uses, having regard to the accompanying drawings. The exemplary embodiments and uses are intended to be illustrative of the present invention. It is not necessary for a particular feature of a particular embodiment to be used exclusively with that particular exemplary embodiment. Instead, any of the features described above and/or depicted in the drawings can be combined with any of the exemplary embodiments, in addition to or in substitution for any of the other features of those exemplary embodiments. One exemplary embodiment's features are not mutually exclusive to another exemplary embodiment's features. Instead, the scope of this disclosure encompasses any combination of any of the features. Further, it is not necessary for all features of an exemplary embodiment to be used. Instead, any of the features described above can be used, without any other particular feature or features also being used. Accordingly, various changes and modifications can be made to the exemplary embodiments and uses without departing from the scope of the invention as defined in the claims that follow.

The embodiments of the invention in which an exclusive property or privilege is claimed are defined as follows:

1. An apparatus for directional drilling of a borehole defined by a borehole wall, the apparatus locatable between an uphole drill string defining a drill string bore for flow of a drilling fluid and a downhole drill bit defining a drill bit opening for flow of the drilling fluid, the apparatus comprising:

(a) a bent tubular housing for orienting the drill bit at a predetermined angle, wherein when the apparatus is disposed in the borehole, the drilling fluid is pumped through the bent tubular housing and exits the drill bit opening at the predetermined angle into an outer annular space defined between an outer wall of the housing and the borehole wall;

(b) a drive shaft for coupling rotation of the drill string to the drill bit, wherein the drive shaft is disposed within the housing, and when the drill string and the drill bit are coupled to the drive shaft, the drilling fluid flows through the drill string bore into an inner annular space defined between an inner wall of the housing and the drive shaft and exits the drill bit opening;

(c) at least one piston positioned within a piston chamber attached to the housing, the drilling fluid flows from the inner annular space into the piston chamber to move the piston relative to the housing to, in use, apply force to the borehole wall and thereby limit rotation of the housing within the borehole;

(d) a biasing means, wherein the piston, the piston chamber and the biasing means are arranged such that either a drilling fluid pressure in the piston chamber urges the piston in a first direction towards the borehole wall, and the biasing means urges the piston in a second direction away from the borehole wall, or the drilling fluid pressure in the piston chamber urges the piston in a first direction away from the borehole wall, and the biasing means urges the piston in a second direction towards the borehole wall;

(e) at least one valve for selectively controlling drilling fluid flow between the outer annular space and the piston chamber, relative to drilling fluid flow between the inner annular space and the piston chamber and thereby, in use, controlling the drilling fluid pressure in the piston chamber; and (f) a clutch for selectively coupling the housing to the drive shaft for rotation with the drive shaft and for adjusting the tool face of the housing.

2. The apparatus of claim 1, wherein the valve is actuable between a first state and a second state, wherein:

(a) in the first state, the valve prevents drilling fluid communication from the inner annular space to the piston chamber, and permits drilling fluid communication from the piston chamber to the outer annular space; and (b) in the second state, the valve permits drilling fluid communication from the inner annular space to the piston chamber, and prevents drilling fluid communication from the piston chamber to the outer annular space.

3. The apparatus of claim 2, wherein the piston chamber is in drilling fluid communication with the inner annular space via an inlet passage defined by the housing.

4. The apparatus of claim 3, wherein the piston chamber is in drilling fluid communication with the outer annular space via an outlet passage defined by the housing.

5. The apparatus of claim 4, wherein the drive shaft comprises a tubular uphole portion for drilling fluid communication between the drill string bore and the inner annular space.

6. The apparatus of claim 5, wherein the drive shaft comprises a tubular downhole portion for drilling fluid communication between the inner annular space and the drill bit opening.

7. The apparatus of claim 6, wherein the drive shaft comprises a tubular intermediate portion, and a universal joint coupling the tubular intermediate portion to the tubular downhole portion for permitting rotation of the drive shaft within the housing while accommodating a bend angle of the housing.

8. The apparatus of claim 7, wherein the clutch comprises a clutch member attached to the inner wall of the housing, the clutch member being actuable to extend radially inwards to be operably connected or into engagement with the drive shaft.

9. The apparatus of claim 8, wherein the valve is selected from a two-way valve, a solenoid valve, or an annular valve member.

10. The apparatus of claim 9, wherein the valve, the clutch, or both are remotely controllable from outside of the borehole.

11. The apparatus of claim 10, comprising one valve or more than one valve.

12. The apparatus of claim 11, comprising more than one piston.

13. The apparatus of claim 12, further comprising an electronic control module comprising a first processor attached to the housing and a second processor at surface and remotely communicating with the first processor for operating the apparatus.

14. A method for directional drilling of a borehole defined by a borehole wall, the method comprising the steps of:

(a) positioning an apparatus within the borehole, the apparatus located between an uphole drill string defining a drill string bore and a downhole drill bit defining a drill bit opening, the apparatus comprising:

(i) a bent tubular housing for orienting the drill bit at a predetermined angle, wherein the drilling fluid is pumped through the bent tubular housing and exits the drill bit opening at the predetermined angle into an outer annular space defined between an outer wall of the housing and the borehole wall;

(ii) a drive shaft within the housing for coupling rotation of the drill string to the drill bit, wherein the drive shaft is disposed within the housing, wherein the drilling fluid flows through the drill string bore into an inner annular space defined between an inner wall of the housing and the drive shaft and exits the drill bit opening;

(iii) at least one piston positioned within a piston chamber attached to the housing, the drilling fluid flows from the inner annular space into the piston chamber to move the piston relative to the housing to, in use, apply force to the borehole wall and thereby limit rotation of the housing within the borehole; and (iv) a biasing means, wherein the piston, the piston chamber and the biasing means are arranged such that either a drilling fluid pressure in the piston chamber urges the piston in a first direction towards the borehole wall, and the biasing means urges the piston in a second direction away from the borehole wall, or the drilling fluid pressure in the piston chamber urges the piston in a first direction away from the borehole wall, and the biasing means urges the piston in a second direction towards the borehole wall;

(v) at least one valve for selectively controlling drilling fluid flow between the outer annular space and the piston chamber, relative to drilling fluid flow between the inner annular space and the piston chamber and thereby, in use, controlling the drilling fluid pressure in the piston chamber; and (vi) a clutch for selectively coupling the housing to the drive shaft for rotation with the drive shaft and for adjusting the tool face of the housing;

(b) flowing the drilling fluid from the drill string bore to the outer annular space via the inner annular space and the drill bit opening to establish a drilling fluid pressure differential between the inner annular space and the outer annular space;

(c) actuating the clutch for selectively coupling the housing to the drive shaft for rotation with the drive shaft and for adjusting the tool face of the housing; and (d) actuating the at least one valve to selectively control drilling fluid flow between the outer annular space and the piston chamber, relative to drilling fluid flow between the inner annular space and the piston chamber, and thereby control drilling fluid pressure in the piston chamber to urge the piston to press against the borehole wall and thereby limit rotation of the housing within the borehole.

15. The method of claim 14, wherein actuating the valve comprises actuating the valve between a first state and a second state, wherein:

(a) in the first state, the valve prevents drilling fluid communication from the inner annular space to the piston chamber, and permits drilling fluid communication from the piston chamber to the outer annular space; and (b) in the second state, the valve permits drilling fluid communication from the inner annular space to the piston chamber, and prevents drilling fluid communication from the piston chamber to the outer annular space.

16. The method of claim 15, wherein the drilling fluid flows between the inner annular space and the piston chamber via an inlet passage defined by the housing.

17. The method of claim 16, wherein the drilling fluid flows between the outer annular space and the piston chamber via an outlet passage defined by the housing.

18. The method of claim 17, wherein the drilling fluid flows from the drill string bore to the inner annular space via a tubular uphole portion of the drive shaft.

19. The method of claim 18, wherein the drilling fluid flows from the inner annular space to the drill bit opening via a tubular downhole portion of the drive shaft.

20. The method of claim 19, wherein the drive shaft comprises a tubular intermediate portion, and a universal joint coupling the tubular intermediate portion to the tubular downhole portion for permitting rotation of the drive shaft within the housing while accommodating a bend angle of the housing.

21. The method of claim 20, wherein the clutch comprises a clutch member attached to the inner wall of the housing, the clutch member being actuable to extend radially inwards to be operably connected or into engagement with the drive shaft.

22. The method of claim 21, wherein the valve is selected from a two-way valve, a solenoid valve, or an annular valve member.

23. The method of claim 22, wherein actuating the valve, the clutch, or both comprises remotely controlling the valve from outside of the borehole.

24. The method of claim 23, comprising one valve or more than one valve.

25. The method of claim 24, comprising more than one piston.

26. The method of claim 25, wherein the apparatus is electronically controlled by an electronic control module comprising a first processor attached to the housing and a second processor at surface and remotely communicating with the first processor.

* * * * *